US007329476B2

(12) United States Patent
Sacripante et al.

(10) Patent No.: US 7,329,476 B2
(45) Date of Patent: Feb. 12, 2008

(54) TONER COMPOSITIONS AND PROCESS THEREOF

(75) Inventors: Guerino G. Sacripante, Oakville (CA); Ke Zhou, Mississauga (CA); Richard P. N. Veregin, Mississauga (CA); Edward G. Zwartz, Mississauga (CA); Maria N. V. McDougall, Burlington (CA)

(73) Assignee: Xerox Corporation, Norwalk, CT (US)

( * ) Notice: Subject to any disclaimer, the term of this patent is extended or adjusted under 35 U.S.C. 154(b) by 425 days.

(21) Appl. No.: 11/094,962

(22) Filed: Mar. 31, 2005

(65) Prior Publication Data

US 2006/0222991 A1 Oct. 5, 2006

(51) Int. Cl.
*G03G 9/087* (2006.01)

(52) U.S. Cl. ..... 430/103.4; 430/137.1

(58) Field of Classification Search ..... 430/109.4, 430/137.1

See application file for complete search history.

(56) References Cited

U.S. PATENT DOCUMENTS 1,032,804 A 7/1912 Baldwin
1,442,835 A 1/1923 Surplus
3,018,272 A 1/1962 Griffing et al.
3,467,634 A 9/1969 Jacknow et al.
3,526,533 A 9/1970 Jacknow et al.
3,563,942 A 2/1971 Heiberger
3,590,000 A 6/1971 Palermiti et al.
3,681,106 A 8/1972 Burns et al.
3,734,874 A 5/1973 Kibler et al.
3,800,588 A 4/1974 Larson et al.
3,909,482 A 9/1975 Najour et al.
3,944,493 A 3/1976 Jadwin et al.
3,998,747 A 12/1976 Yamakami et al.
4,007,293 A 2/1977 Mincer et al.
4,049,447 A 9/1977 Azar et al.
4,052,325 A 10/1977 Santilli
4,079,014 A 3/1978 Burness et al.
4,140,644 A 2/1979 Sandhu et al.
4,265,990 A 5/1981 Stolka et al.
4,288,516 A 9/1981 Gaudioso
4,298,672 A 11/1981 Lu
4,338,390 A 7/1982 Lu
4,340,519 A 7/1982 Kotera et al.
4,394,430 A 7/1983 Jadwin et al.
4,416,965 A 11/1983 Sandhu et al.
4,446,302 A 5/1984 Sandhu et al.
4,451,837 A 5/1984 Gruber et al.
4,465,712 A 8/1984 McVie
4,478,423 A 10/1984 Hjelsand et al.
4,489,150 A 12/1984 Chang et al.
4,513,074 A 4/1985 Nash et al.
4,525,445 A 6/1985 De Roo et al.
4,525,524 A 6/1985 Tung et al.
4,533,614 A 8/1985 Fukumoto et al.
4,543,313 A 9/1985 Mahabadi et al.
4,560,635 A 12/1985 Hoffend et al.
4,563,408 A 1/1986 Lin et al.
4,584,253 A 4/1986 Lin et al.
4,585,884 A 4/1986 Lin et al.
4,656,112 A 4/1987 Kawagishi et al.
4,657,837 A 4/1987 Morita et al.
4,693,952 A 9/1987 Koizumi et al.
4,814,249 A 3/1989 Oseto et al.
4,837,394 A 6/1989 Alexandrovich et al.
4,845,003 A 7/1989 Kiriu et al.
4,845,006 A 7/1989 Matsubara et al.
4,863,824 A 9/1989 Uchida et al.
4,863,825 A 9/1989 Yoshimoto et al.
4,866,158 A 9/1989 Kubo et al.
4,883,736 A 11/1989 Hoffend et al.
4,891,293 A 1/1990 Sacripante et al.
4,917,983 A 4/1990 Uchida et al.
4,931,370 A 6/1990 Amaya et al.
4,933,252 A 6/1990 Nishikawa et al.
4,935,326 A 6/1990 Creatura et al.
4,937,166 A 6/1990 Creatura et al.
4,940,644 A 7/1990 Matsubara et al.
4,957,774 A 9/1990 Doi et al.
4,960,664 A 10/1990 Yamada et al.
4,968,575 A 11/1990 Matsumura et al.
4,973,539 A 11/1990 Sacripante et al.
4,980,448 A 12/1990 Tajiri et al.
4,981,939 A 1/1991 Matsumura et al.
4,988,794 A 1/1991 Kubo et al.

(Continued)

*Primary Examiner*—Hoa Van Le
(74) *Attorney, Agent, or Firm*—Pillsbury Winthrop Shaw Pittman, LLP

(57) ABSTRACT

A toner composition is provided which contains a polyester resin with hydrophilic groups and hydrophobic end groups and a colorant, wherein said polyester resin is of the formula:

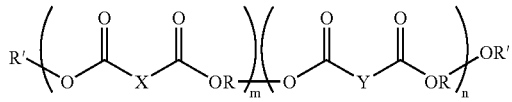

wherein R is an alkylene group;
X is an aromatic hydrocarbon;
Y is selected from the group consisting of an alkali and an alkaline earth metal salt of an arylenesulfonate or an alkylenesulfonate;
R' is a hydrophobic group, and
m and n represent the number of random segments of from about 50 to about 300 for n, and from about 20 to about 2,000 for m, and m is less than 20 times n.

26 Claims, No Drawings

U.S. PATENT DOCUMENTS 5,004,664 A 4/1991 Fuller et al.
5,043,242 A 8/1991 Light et al.
5,045,424 A 9/1991 Rimai et al.
5,047,305 A 9/1991 Uchida et al.
5,049,646 A 9/1991 Tyagi et al.
5,057,392 A 10/1991 McCabe et al.
5,057,596 A 10/1991 Kubo et al.
5,102,762 A 4/1992 Tyagi et al.
5,110,977 A 5/1992 Wilson et al.
5,116,713 A 5/1992 Uchida et al.
5,143,809 A 9/1992 Kaneko et al.
5,153,301 A 10/1992 Tajiri et al.
5,168,028 A 12/1992 Nanya et al.
5,229,242 A 7/1993 Mahabadi et al.
5,324,613 A 6/1994 Ciccarelli et al.
5,348,832 A 9/1994 Sacripante et al.
5,368,970 A 11/1994 Grushkin
5,391,452 A 2/1995 Sacripante et al.
5,456,998 A 10/1995 Burt et al.
5,466,554 A 11/1995 Sacripante et al.
5,466,796 A 11/1995 Burt et al.
5,534,376 A 7/1996 Mayo et al.
5,563,261 A 10/1996 Keoshkerian et al.
5,593,807 A 1/1997 Sacripante et al.
5,604,076 A 2/1997 Patel et al.
5,645,965 A 7/1997 Duff et al.
5,648,193 A 7/1997 Patel et al.
5,658,704 A 8/1997 Patel et al.
5,660,965 A 8/1997 Mychajlowskij et al.
5,684,063 A 11/1997 Patel et al.
5,698,223 A 12/1997 Mychajlowskij et al.
5,698,422 A 12/1997 Sacripante et al.
5,840,462 A 11/1998 Foucher et al.
5,866,290 A 2/1999 Sacripante et al.
5,932,677 A 8/1999 Hoover et al.
6,017,671 A 1/2000 Sacripante et al.
6,143,457 A 11/2000 Carlini et al.
6,190,815 B1 2/2001 Ciccarelli et al.
6,291,122 B1 9/2001 Sacripante et al.
6,348,561 B1 2/2002 Mychajlowskij et al.
6,387,442 B1 * 5/2002 Moffat et al. ..... 427/180
6,432,601 B1 8/2002 Foucher et al.
6,664,015 B1 12/2003 Sacripante et al.
6,673,501 B1 * 1/2004 Combes et al. ..... 430/108.22
6,698,422 B2 3/2004 Fugelsang et al.
6,780,560 B2 8/2004 Farrugia et al.
6,818,723 B2 11/2004 Sacripante
6,824,944 B2 11/2004 Sacripante et al.
6,830,860 B2 12/2004 Sacripante et al.
6,835,768 B2 12/2004 Agur et al.
6,849,371 B2 2/2005 Sacripante et al.
6,850,725 B2 2/2005 Silence et al.
2003/0175609 A1 * 9/2003 Combes et al. ..... 430/108.22
2003/0232268 A1 12/2003 Sacripante et al.
2004/0044108 A1 3/2004 Agur et al.
2004/0142266 A1 7/2004 Sacripante et al.
2004/0146798 A1 7/2004 Farrugia et al.
2004/0166430 A1 8/2004 Sacripante et al.

* cited by examiner

TONER COMPOSITIONS AND PROCESS THEREOF

BACKGROUND

Disclosed are toner compositions and processes thereof, and more specifically disclosed are toner compositions comprised of a mixture of a toner and developer compositions, and more specifically, to a developer composition comprised of carrier, and toner containing a polyester with both hydrophilic and hydrophobic groups and wherein the main chain of the resin contains a hydrophilic moiety, for example, wherein hydrophilic moiety refers to a group or groups on the main polymer chain in an amount of, for example, from about 3 to about 8 mole percent based on the amount of toner polyester polymer, or parts which, for example, impart or assist in imparting excellent triboelectrical and with rapid admix characteristics, and wherein the end groups of the polyester resin are modified with or contain hydrophobic moieties, groups, or segments; in certain embodiments two hydrophobic moieties or groups are present in an amount of, for example, from about 0.5 to about 5 percent or parts based on the amount of polyester polymer to, for example, impart or assist in imparting excellent relative humidity sensitivity to the toner. In embodiments, there are provided toner compositions comprised of colorant particles, and resin particles comprised of a polyester resin containing hydrophilic moieties such as a sodio sulfonate group or groups, in an amount for the moieties, groups, or segments of, for example, from about 3 to about 8 weight percent of the polyester resin or polymer, or from about 4 to about 6 weight percent of the resin, and hydrophobic end groups, for example nonpolar, or nonwater liking groups such as alkyl, alkylene, with, for example, from 6 to about 120 carbon atoms, such as stearyl, cetyl, polyethylene, polypropylene and the like. More specifically, in embodiments of the present invention, there is provided a toner comprised of colorant, pigment particles, optionally a charge enhancing agent, optionally a wax component, and a polyester resin containing both hydrophilic moieties on the main chain, and hydrophobic end groups, and which polyester is illustrated by Formula I

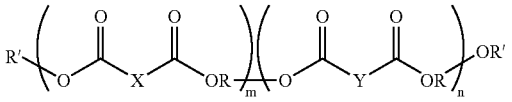

I wherein R can be an alkylene group, such as a diethylene, propylene, dipropylene and butylene, or generally a hydrocarbon, with from about 2 to about 24 carbon atoms, or from about 10 to about 20 carbon atoms; a cycloalkylene like cyclohexylene or a 1,4-dimethyl cyclohexylene group, and the like; X can be an aromatic group, such as arylene, with, for example, from about 6 to about 14 carbon atoms, such as phenylene, isophthalylene, terephthalylene or phthalylene; an olefinic group (or groups throughout), such as vinylene, methylvinylene, or an alkylene group such as ethylene, propylene, butylene, pentylene, hexylene, and the like; R' is a hydrophobic group or groups, for example, hydrocarbons such as an aliphatic hydrocarbon having the formula —$(CH_2)_p$—$CH_3$, wherein p is a number of from about 10 to about 120, or from about 20 to about 60, and the molecular weight of the hydrocarbon may range from about 300 to about 1000, or from about 350 to about 700; and m and n represent the number of random segments, such as a number of from about 50 to about 300 for n, and from about 20 to about 2,000 for m; or m is less than 20 times n; Y is a hydrophilic group, such as an alkali earth metal salt of an arylenesulfonate or alkylenesulfonate, and the alkaline earth metal is, for example, lithium, sodium, potassium, cesium, berylium, magnesium, calcium or barium; the arylenesulfonate is, for example, phenylenesulfonate, isophthalylene-5-sulfonate, terephthalylene-sulfonate or phthalylenesulfonate, and the alkylenesulfonate is, for example, propylenesulfonate, butylenesulfonate, pentylenesulfonate, or hexylenesulfonate. The polyester resin can be branched or crosslinked by employing trifunctional or multifunctional reagents, such as trimethylolpropane or pyromellitic acid, in an amount of, for example, from about 0.1 to about 6 mole percent based on the starting diacid or diester selected to prepare the polyester resin, and which branching agent can be represented in the above Formulas I by incorporating the branching segments, p, q, r or s as illustrated by the formulas.

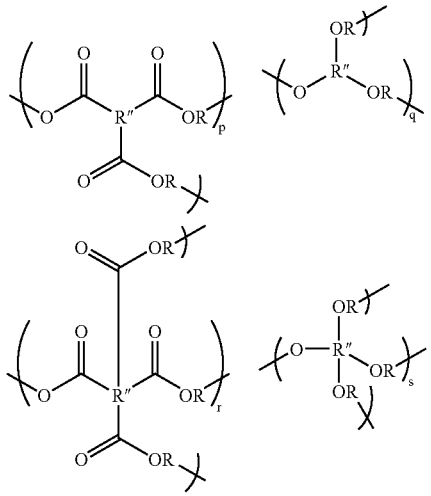

wherein R" is a multivalent aromatic radical with, for example, from about 6 to about 30 carbon atoms, or an aliphatic radical with from about 3 to about 20 carbon atoms, such as the tri or tetravalent derivatives of propane, butane, pentane, hexane, cyclohexane, heptane, octane, benzene, naphthalene, anthracene, and the like; and p, q, r and s represent the branching segment and in embodiments each is from about 0.1 to about 6 mole percent based on the starting diacid or diester used to generate the resin and provided that the sum of segments p and q, or r and s is 100 mole percent of the polyester resin.

In embodiments, the present invention relates to the preparation of a polyester resin, and wherein the hydroxyl and acid end groups of the resulting polyester are minimized, and preferably avoided. Polyester resins are known to contain acid and hydroxyl groups of from about 20 to about 1,000 milliequivalents per gram of polyester, usually present as end groups. It is believed that these hydrophilic end groups may cause the toner composites to possess tribocharging performance that is humidity sensitive, wherein the ratio of the triboelectric charge of the toner composites at low humidity to that at high humidity is of from about 2.8 to about 4.5, and usually from about 3.0 to about 3.5. To reduce the relative humidity sensitivity of polyester based toners, the present toner composition minimizes the hydrophilic end groups, such as hydroxyl or acid moieties on the polyester resin, by capping the ends of the polyester with hydrophobic groups, with for example, aliphatic hydrocarbons, such as alkyl moieties, hence resulting in toners with low humidity sensitivity in embodiments such as from about 1.0 to about 2.8, or from about 1.0 to about 2.5.

In another embodiment, there is provided a toner composition with excellent triboelectrical stability and rapid admix such as less than about 1 minute and preferable less than about 30 seconds, for example from about 5 to about 15 seconds, and which toner contains a polyester resin with a hydrophilic moiety, such as a sodio sulfonate group, present on the main chain of the resin. A further embodiment of the present invention relates to the preparation of a polyester resin with monofunctional monomers that cap the ends of the polyester resin to result in the aforementioned polyester resin with hydrophobic end groups, and wherein the concentration of the monofunctional hydrophobic monomers is from about 0.1 mole percent to about 5 mole percent based on the starting diacid or diester used to generate the resin, and thereby controls the weight average molecular weight of from about 4,000 grams per mole to about 250,000 grams per mole, especially when monofunctional monomers with a carbon chain length of from about 4 to about 24 are selected or wherein the use of bulkier monomers such as 1,2-naphthalene ethanol, or phenylmethanol are utilized; and wherein a hydrophilic moiety such as sodio sulfonate group is present in the main chain of the polyester resin, and wherein the concentration of the hydrophilic moiety is from about 3 to about 8 weight percent of the resin, or from about 4 to about 6 weight percent of the resin.

In embodiments, the aforementioned toner composition and developer thereof, that is toner mixed with a carrier, display a low relative humidity sensitivity for the toners, which is desired since the triboelectric charge remains stable with changes in environmental humidity conditions. Additionally, the toners possess rapid admix characteristics, such as less than about 60 seconds, and preferably less than 30 seconds, for example from about 5 to about 15 seconds, and low minimum fixing temperatures, such as from about 130° C. to about 145° C., with broad fusing latitudes, such as from about 30° C. to about 90° C. Copiers and printers equipped with two component developers, that is a toner as one component mixed with the carrier as the other component, can exhibit a positive or negative triboelectric charge with a magnitude of from about 5 microcoulombs per gram to about 40 microcoulombs per grams. This triboelectric charge permits the toner particles to be transferred to the latent image of the photoreceptor with an opposite charge, thereby forming a toned image on the photoreceptor, which is subsequently transferred to a paper or a transparency substrate, and thereafter subjected to fusing or fixing processes. In these development systems, it is important for the triboelectric charge to be stable under differing environmental humidity conditions such that the triboelectric charge does not change substantially by more than from about 5 to about 10 microcoulombs per gram. A change of more than from about 5 microcoulombs per gram to about 10 microcoulombs per gram in the triboelectric charge of the toner developer can cause nonuniform toned images or result in no toning of the photoreceptor, thus unbalanced density or gray scale is observed in the developed images, or no developed images at all result. Humidity ranges may differ from less than about 20 percent in dry regions to more than about 80 percent in humid regions, and some geographical regions may exhibit fluctuations of up to from about 50 to about 90 percent humidity level within the same day. In such climates, it is important that the developmental triboelectric charge does not change by more than from about 5 microcoulombs per gram to about 10 microcoulombs per gram. As toner resins generally represent from about 80 percent to about 98 percent by weight of toner, the resin sensitivity to moisture or humidity conditions should be minimized thereby not adversely affecting the triboelectric charge thereof. Furthermore, the toners should preferably possess rapid admix characteristics, such that when copiers and printers are replenished with fresh toners, the developers can re-establish the necessary triboelectric charge within less than 1 minute, and preferably less than 30 seconds.

A number of toner polymeric resins utilized as toner compositions, such as for example styrene-acrylates, styrene-methacrylates, styrene-butadienes and especially polyesters, contain from about 0.1 to about 2 percent by weight of moisture, and in some instances, the moisture content of polyesters may change from about 0.1 to about 4 percent by weight at humidity levels ranging from about 10 to about 100 percent, or more usually from about 20 percent to about 80 percent humidity. These changes in moisture content of the resin may have a dramatic adverse effect on the triboelectric charge of the toner and developer thereof. Relative humidity sensitivity of toner is customarily measured by first fabricating a toner comprised of a pigment, optional charge control agent and a resin, then admixing the toner from about 3 percent by weight to about 7 percent by weight with a carrier. The developer composition is then equilibrated to various humidity levels in a sealed chamber at controlled temperatures of 60° F. at 20 percent relative humidity and 80° C. at 80° F. for a period of about 48 hours. The triboelectric charge is then measured for the same developer composition at different humidity levels and the results analyzed by several methods, such as graphing the triboelectric charge as a function of humidity level and observing the regions in which dramatic changes occur. Another measuring method comprises dividing the aforementioned graphical interpolation of tribo versus humidity level in three regions, wherein region A is from about 0 to about 30 percent humidity, region B is from about 30 to about 65 percent humidity, and region C is higher than about 65 percent humidity to about 100 percent. Since these measurements are cumbersome and time consuming, there can be measured the triboelectric charge after subjecting the toner developer composition to two humidity levels, such as 20 percent relative humidity and 80 percent relative humidity, and then calculating the relative sensitivity by the triboelectric charge ratio of the 20 to 80 percent relative humidity as follows.

$$\text{Relative Humidity } (RH) \text{ Sensitivity} = \frac{\text{Triboelectric charge at } 20\%\ RH \text{ at } 60^{\circ}F}{\text{Triboelectric Charge at } 20\%\ RH \text{ at } 80\mu^{\circ}F}$$

If the relative humidity sensitivity of a toner is about 1, the toner composition is considered humidity insensitive, whereas if the humidity sensitivity is greater than about 3, the toner composition is considered to be humidity sensitive. It is generally believed that toners prepared with a number of polymeric materials exhibit relative sensitivity greater than 1.0, and in general, styrene butadiene, or styrene acrylate based toners possess humidity sensitivities greater than 1.0 and less than about 2.5, whereas generally, polyester based toners possess a relative humidity sensitivity of greater than 2.5 and less than about 5. Hence, an advantage of the styrene-acrylate or styrene-butadiene type binder resins for toners over that of polyesters is their lower relative humidity sensitivity. Polyesters are known to display advantages over styrene based resins, such as low fixing temperatures of from about 120° C. to about 140° C., and nonvinyl offset properties. Therefore, there is a need for toner compositions comprised of a resin which possess many of the aforementioned advantages, such as low fixing temperature of from about 120° C. to about 140° C., nonvinyl offset properties, and in addition low sensitivity of tribocharging as a function of relative humidity such that the ratio of triboelectric charge at 20 percent and 80 percent RH is from about 1.0 to about 2.5. These and other advantages are attained in embodiments with the toner compositions of the present invention comprised of a pigment, optionally a charge control agent, and a modified polyester resin wherein the end groups are hydrophobic moieties, and which toner exhibits a low fixing temperature of from about 120° C. to about 140° C., nonvinyl offset properties, and low relative humidity sensitivity, such as from about 1.0 to about 2.5.

Furthermore, the presence of the hydrophobic end groups on the polyester provide an improved process for obtaining polyesters, and the polyester resin has more sulfonation. The process for the preparation of the polyester resins is referred to as a condensation process or step polymerization and the resultant polyester resin is comprised of an increased sulfonation characteristics. The condensation process involves the addition of bifunctional monomers which result in dimers, followed by the reaction of dimers with dimers to form tetramers, or dimers with monomers to form trimers. The reaction sequence then continues in that these dimers, trimers and tetramers react with each other to form multiple segments such as oligomers, which in turn react with other oligomers to form the polyester. In this kinetic scheme, the degree of polymerization is achieved by terminating the reaction at the desired point, hence it is time dependent. It is known that obtaining a specific degree of polymerization by relying on the time of the polymerization of the step reaction polymerization process is very difficult. A method for controlling the degree of polymerization is to adjust the composition of the reaction mixture away from stoichiometric equivalence, by adding a nonvolatile monofunctional reagent in an amount from about 0.1 mole percent to about 5 mole percent based on the starting diacid or diester used to make the resin. In the present invention, the monofunctional monomers employed are, for example, hydrophobic monomers. The degree of polymerization can further be controlled by the amount of monofunctional monomer utilized, hence limiting the degree of polymerization as determined by its concentration such that the total amount of end groups is proportional to the amount of monofunctional monomer employed. This aids in the reproducibility of the product by adjusting the amount of monofunctional monomer to the desired limit of degree of polymerization, hence avoiding total dependence on time of polymerization.

Additionally, the toner resin contains a hydrophilic moiety, such as an alkali salt of a sulfonate group, which group is believed to impart triboelectric stability for long duration, such as from about 250,000 to about 1,000,000 prints or copies, and which function also enables rapid admix times such as less than about 1 minute and preferable less than about 30 seconds.

The toner compositions in embodiments thereof possess excellent admix characteristics as indicated herein, and maintain their triboelectric charging characteristics for an extended number of imaging cycles up to, for example, 1,000,000 in a number of embodiments.

There is a need for toners with low relative humidity sensitivity, such as from about 1 to about 2.8 and preferably from about 1 to about 2.5 as calculated by Equation 1, and wherein excellent triboelectric stability is achieved, such as from about 250,000 to 1,000,000 prints or copies, as rapid admix time, such as from less than about 1 minute and preferably less than about 30 seconds, and wherein low minimum fixing temperatures are obtained, such as from about 120° C. to about 140° C. with broad fusing latitude such as from about 30° C. to about 45° C., wherein the fusing latitude is considered the difference between the minimum fixing temperature and the temperature at which the toner offsets to the fusing member. Additionally, there is a need for polyester resin for use in toners which can maintain the toner charge. These and other needs can be achievable in embodiments illustrated herein.

REFERENCES

Certain sulfonated polyester resins are known, reference for example U.S. Pat. No. 3,018,272, the disclosure of which is totally incorporated herein by reference, wherein a variety of sulfoacids and metalized sulfonates are incorporated into a polyester resin. In U.S. Pat. No. 3,563,942, the disclosure of which is totally incorporated herein by reference, there are disclosed linear solvent soluble copolyester compositions that can be dispersed in water. Water dispersibility can be achieved, it is believed, by the addition to the copolyester of a small amount (1-2 mole percent) of a metal salt of a sulfonated aromatic compounds. Water dispersible or dissipatible polyester resins are also known, such as those disclosed in U.S. Pat. No. 3,734,874, the disclosure of which is totally incorporated herein by reference, and wherein these sulfonated polyester resins can be derived from a polyethylene glycol and dicarboxylic acid metal salts of 5-sulfoisophthalic acid. U.S. Pat. No. 4,340,519, the disclosure of which is totally incorporated herein by reference, discloses certain crystalline and noncrystalline polyesters copolymerized with a metal sulfonate group containing aromatic acid and up to 10 mole percent (based on the total polyol content) of a polyvalent polyol selected from trimethylolpropane, trimethylolethane, glycerine, and pentaerythritol. Also, U.S. Pat. No. 4,525,524, the disclosure of which is totally incorporated herein by reference, discloses liquid systems comprised of polyester-containing certain metal sulfonates and, optionally, up to 3 percent of a branching agent based upon the total diol component. Other water dispersible polyester based resins comprised of hydrophilic moieties, such as alkali sulfonate groups, are disclosed, for example, in U.S. Pat. Nos. 5,348,832; 5,593,807; 5,604,076; 5,648,193; 5,658,704; 5,660,965; 5,684,063; 5,698,223, and 6,664,015, the disclosures of which are each totally incorporated herein by reference. The aforementioned dissipatible polyester resins usually contain hydrophilic moieties in an amount of from about 0.5 to about 7.5 percent by weight of resin.

U.S. Pat. Nos. 5,698,422 and 5,866,290, the disclosures of which are each totally incorporated herein by reference, disclose attaching a hydrophobic wax like material to polyester resins, wherein the amount of hydrophobic material attached to the polyester resin was varied to control the wax domain size of a wax containing toner to provide with enhanced fuser release of oil-less toners; however, the chemical attachment of the hydrophobic chains to the polyester end groups, reduces the amount of acidic functionality of the resin, thus reducing the charge characteristics of the toner developer.

Polyester-siloxane copolymers are also known, such as those disclosed in U.S. Pat. No. 4,465,712, the disclosure of which is totally incorporated herein by reference, and wherein a siloxane-polyester composition comprised of the siloxane-polyester copolymer indicated are useful for the coating of substrates, such as metals and plastics. In U.S. Pat. No. 5,932,677, the disclosure of which is totally incorporated herein by reference, there is illustrated a thermoplastic condensation polymer which are terpolymers containing an aromatic polyester, a polysiloxane and a polycarbonate segment. U.S. Pat. Nos. 6,664,015 and 6,818,723, the disclosures of which are totally incorporated herein by reference, disclose a sulfonated polyester-siloxane resin generated from the reaction of at least one organic diol monomer, at least one organic diacid or at least one diester monomer, at least one carbinol carboxy termined polydimethyl siloxane, and at least one ion salt of a sulfonated difunctional monomer.

Certain polyester toner resins are known, reference for example U.S. Pat. Nos. 3,590,000 and 4,525,445, which illustrate a linear polyester comprised preferably of propoxylated bisphenol A and fumaric acid, and available as SPAR II.RTM. from a number of sources such as Atlas Chemical Company. There is also disclosed in Japanese Laid Open Patents. Further, there is disclosed in U.S. Pat. No. 4,533,614, and more specifically, U.S. Pat. Nos. 4,957,774 and 4,533,614 linear polyester resins comprised of dodecylsuccinic anhydride, terephthalic acid, alkyloxylated bisphenol A and trimellitic anhydride as chain extenders.

Additionally, there is disclosed in U.S. Pat. Nos. 4,940,644, 5,047,305, 4,049,447, and Canadian Patent 1,032,804 a linear polyester comprised of an amorphous aromatic polyester derived from an arylene radical and diol, and specifically resins such as poly(neopentylterephthalate) comprised of terephthalate radical and neopentyl glycol. Also, there is disclosed in U.S. Pat. No. 4,525,445 a toner composition comprised of a linear polyester derived from fumaric acid, isophthalic acid and propoxylated bisphenol. Further, other toner compositions are known to contain linear polyester resins, such as those disclosed in U.S. Pat. No. 4,968,575 a linear polyester blocked with rosin compound; U.S. Pat. No. 5,004,664 a linear polyester prepared from the ring opening polymerization of cyclic monomers; U.S. Pat. No. 5,057,392 a blend of resins comprised of a crystalline and amorphous polyesters; and U.S. Pat. Nos. 4,543,313 and 4,891,293 wherein there are disclosed linear thermotropic liquid crystalline polyester resins, the disclosures of which are totally incorporated herein by reference. Other U.S. Patents of interest disclosing, for example, linear polyesters are U.S. Pat. Nos. 4,052,325; 3,998,747; 3,909,482; 4,288,516; 4,140,644; 4,489,150; 4,478,423; 4,451,837; 4,446,302; 4,416,965; 4,866,158; 5,153,301; 5,116,713; 5,043,242; 5,045,424; 5,049;646; 5,102,762; 5,110,977 and 4,837,394.

Compositions containing modified polyester resins with a polybasic carboxylic acid are also known and disclosed in U.S. Pat. No. 3,681,106, and more specifically branched or crosslinked polyesters derived from polyvalent acids or alcohols are illustrated in U.S. Pat. Nos. 4,298,672; 4,863,825; 4,863,824; 4,845,006; 4,814,249; 4,693,952; 4,657,837; 5,143,809; 5,057,596; 4,988,794; 4,981,939; 4,980,448; 4,960,664; 4,933,252; 4,931,370; 4,917,983 and 4,973,539. In some of the aforementioned prior art references, there are disclosed polyester resins wherein the end groups are either an acid group, wherein acid numbers are reported, and/or wherein hydroxyl groups are present.

Polyester based resins comprised of hydrophilic moieties such as alkali sulfonate groups are known, and disclosed in U.S. Pat. Nos. 5,348,832; 5,593,807; 5,604,076; 5,648,193; 5,658,704; 5,660,965; 5,684,063; and 5,698,223, the disclosure of which is totally incorporated herein by reference. The aforementioned prior art polyester resins contain hydrophilic moieties, preferably in an amount range of from about 2 to about 7.5 percent by weight of resin, and utilized such that dissipation, or emulsification of the resin in water is obtained.

To prevent fuser roll offsetting and to increase the fuser latitude of toners, various modifications to toner compositions have been proposed. For example, U.S. Pat. No. 4,513,074 discloses adding waxes, such as low molecular weight polyethylene, polypropylene, to toners to increase their release properties. To sufficiently prevent offset, however, considerable amounts of such materials may be required, resulting in the detrimental effect of toner agglomeration, degradation in free flow properties, and destabilization of charging properties.

There is illustrated in U.S. Pat. No. 5,168,028 a negatively chargeable toner for developing latent electrostatic images comprising a binder resin, a coloring agent and a charge controlling agent which comprises a fluorine-containing quaternary ammonium salt. There are illustrated in U.S. Pat. No. 5,324,613 toners with hydroxy bis(3,5-ditertiary butyl salicylic) aluminate monohydrate; U.S. Pat. No. 4,656,112 toners with a zinc complex (E-84) of 3,5-ditertiary butyl salicylate; and U.S. Pat. No. 4,845,003 toners with a hydroxy carboxylic acid. The disclosures of each of the aforementioned patents are totally incorporated herein by reference.

SUMMARY

Aspects disclosed herein include a toner composition comprised of a polyester resin with hydrophilic moieties, or groups and hydrophobic end groups, colorant, optional wax, optional charge additive, and optional surface additives; wherein said polyester resin of the formula

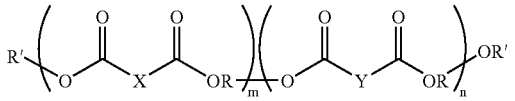

wherein R is an alkylene group selected from the group comprised of diethylene, propylene, dipropylene and butylene, or a hydrocarbon having from about 2 to about 24 carbon atoms; a cycloalkylene or 1,4-dimethyl cyclohexylene group;

X is an aromatic hydrocarbon having from about 6 to about 14 carbon atoms;

Y is an alkali earth metal salt of an arylenesulfonate or an alkylenesulfonate and comprises from about 3 to about 10 mole percent, or from about 3 mole percent to about 8 mole percent, or from about 4 mole percent to about 6 mole percent of the polyester resin;

R' is an aliphatic hydrocarbon having the formula —$(CH_2)_p$—$CH_3$, wherein p is a number of from about 10 to about 120, or from about 20 to about 60, and m and n represent the number of random segments of from about 50 to about 300 for n, and from about 20 to about 2,000 for m; and m is less than 20 times n;

a process for the preparation of a toner composition comprising (a) preparing a polyester resin of the formula

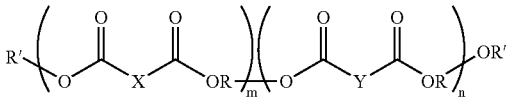

wherein R is an alkylene group;

X is an aromatic hydrocarbon having from about 6 to about 14 carbon atoms;

Y is an alkali or alkaline earth metal salt of an arylenesulfonate or an alkylenesulfonate;

R' is an aliphatic hydrocarbon of from about 10 to about 120, or from about 20 to about 60 carbon atoms in length, and m and n represent the number of random segments of from about 50 to about 300 for n, and from about 20 to about 2,000 for m; and m is less than 20 times n;

by reacting a mixture of dimethylterepthalate, an alkali or alkaline earth metal salt of an arylenesulfonate or an alkylenesulfonate, propylene glycol, diethylene glycol, an acohol having the formula —$OH(CH_2)_p$—$CH_3$, wherein p is a number of from about 10 to about 120, or from about 20 to about 60, and a catalyst in a reactor, heating the mixture at a temperature from about 160° C. to about 215° C. for a period of from about 3 hours to about 10 hours or from about 3 hours to about 8 hours; and reducing the pressure of the reactor and re-pressurizing the reactor at various intervals during heating;

(b) stirring said polyester resin in water for about 4 to about 6 hours at a temperature from about 80° C. to about 100° C. to form an emulsion mixture;

(c) adding a pigment to the emulsion mixture while stirring;

(d) heating the emulsion mixture at a temperature of from about 50° C. to about 75° C. with stirring;

(e) adding a solution comprising a catalyst for a period of from about 1 to about 3 hours to form toner particles;

(f) monitoring said toner particle size in the mixture until the volume particle size is from about 3 to about 7 μm with a geometric distribution of about 1.3;

(g) cooling the mixture to from about 20° C. to about 30° C., or from about 20° C. to about 26° C., or about 25° C. and optionally separating the mixture followed by filtration, washing and freeze-drying the toner particles.

DETAILED DESCRIPTION

In embodiments illustrated herein:

There is provided a toner and developer compositions wherein the polyester toner binder resin contains hydrophilic groups and hydrophobic end groups. The negatively charged toner compositions are useful for the development of electrostatic latent images including color images. In one embodiment, negatively charged toner or positively charged toner compositions comprise a polyester with hydrophobic end groups such as a hydrocarbon of from about 10 carbon atoms to about 120 carbon atoms. The negatively charged toner compositions also comprise a polyester with hydrophilic moieties or groups, such as an alkali salt of a sulfonate moiety such as sodio sulfonate, lithio sulfonate, potassium sulfonate, berylio sulfonate, masio sulfonate or bario sulfonate. Also illustrated herewith are developer compositions with negatively charged toner particles, and carrier particles.

Additionally, illustrated herewith are toners having triboelectric properties with low humidity sensitivity, for example, from about 1.0 to about 2.5. Toners with triboelectric stability can be used to print, for example, from about 250,000 to about 5,000,000 copies or prints in, for example, the Xerox Corporation 6180 printer, and toners with rapid admix time such as, for example, less than about 1 minute and preferably less than about 30 seconds, such as from about 5 to about 30 seconds. In one embodiment, the toners have triboelectric properties with low humidity sensitivity, for example, from about 1.0 to about 2.5, with desirable admix properties of about 15 seconds to about 60 seconds as determined by the charge spectrograph, and preferably about 15 to about 30 seconds. The toners have triboelectric properties with low humidity sensitivity with low minimum fixing temperatures such as from about 120° C. to about 140° C. These toners have suitable triboelectric properties, low humidity sensitivity, and broad fusing latitude, such as from about 30° C. to about 45° C. There is also illustrated herewith a method for reproducibly controlling the degree of polymerization.

Furthermore, there is illustrated toner and developer compositions that are useful in a variety of electrostatic imaging and printing processes, including color xerography, and wherein the admix charging times are less than or equal to about 60 seconds. These and other characteristics of the toner and compositions can be accomplished in embodiments thereof by providing toner compositions comprised of colorant, such as pigment particles, and a polyester resin wherein the end groups are hydrophobic and derived from an alcohol having the formula —$OH(CH_2)_p$—$CH_3$, wherein p is a number of from about 10 to about 120, or from about 20 to about 60.

In one embodiment, a toner composition is comprised of a polyester resin with hydrophilic moieties, or groups and hydrophobic end groups, colorant, optional wax, optional charge additive, and optional surface additives; a toner composition comprised of a polyester resin containing at least one hydrophilic group, at least one hydrophobic group, and colorant; a toner wherein the polyester resin is derived from at least one organic diol monomer, at least one organic diacid or diester monomer, and at least one hydrophobic monofunctional alcohol or monofunctional acid monomer, at least one alkali or alkaline earth metal salt of alkylene sulfonate, an arylene sulfonate diacid, or diester monomer; a toner composition containing a polyester resin of the formula

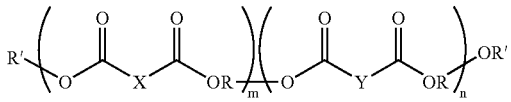

wherein R is a hydrocarbon; X is arylene, an olefinic group or groups, or an alkylene; R' is alkyl or alkylene; and m and n represent the number of random segments; Y is a hydrophilic group, a toner composition wherein R (for the polyester) is an alkylene; a toner composition wherein R is alkylene with from about 2 to about 20 carbon atoms; a toner composition wherein the hydrocarbon possesses from about 2 to about 22 carbon atoms; a toner composition wherein the polyester R is cyclohexylene; a toner composition wherein R is 1,4-dimethyl cyclohexylene; a toner composition wherein the polyester R is ethylene, propylene, butylene, or ethyleneoxyethylene; a toner composition wherein the X arylene possesses from about 6 to about 30 carbon atoms; a toner composition wherein the polyester X is phenylene; a toner composition wherein X is phthalylene; a toner composition wherein X is terephthalylene; a toner composition wherein X is isophthalylene; a toner composition wherein the X olefinic group possesses from about 2 to about 12 carbon atoms; a toner composition wherein the X olefinic group is vinylene; a toner composition wherein the X olefinic group is methylvinylene; a toner composition wherein the X alkylene possesses from about 2 to about 20 carbon atoms; a toner composition wherein the X alkylene is ethylene, propylene, butylene, pentylene or hexylene; a toner composition wherein R' is an aliphatic hydrocarbon of the formula $—(CH_2)_pCH_3$ and p is a number of from 10 to about 120; a toner composition wherein the polyester R' is an aliphatic hydrocarbon of the formula $—(CH_2)_pCH_3$ and p is a number of from 20 to about 60, for example, $—(CH_2)_{50}CH_3$; a toner composition wherein the R' alkylene is polyethylene or polypropylene; a toner composition wherein the polyester m is a number of from about 20 to about 2,000; a toner composition wherein the polyester m is a number of from about 50 to about 125; a toner composition wherein the polyester n is a number of from about 50 to about 300; a toner composition wherein the polyester n is a number of from about 100 to about 200; a toner composition wherein the polyester m is a number of from about 100 to about 500, n is a number of from about 50 to about 75, and wherein m is less than 20 times the value of n; a toner composition wherein the polyester Y is an alkali earth metal salt of an arylene sulfonate; a toner composition wherein Y is an alkali earth metal salt of an alkylene sulfonate; a toner composition wherein Y is an alkaline earth metal salt of an arylene sulfonate, and wherein the metal can be lithium, sodium, potassium, cesium, berylium, magnesium, calcium or barium; a toner composition wherein Y can be an alkali earth metal salt of phenylene sulfonate; a toner composition wherein Y can be an alkali metal salt of isophthalylene 5-sulfonate, terephthalylene sulfonate, or alkylene sulfonate; a toner composition wherein the polyester X can be methylene, propylene, ethylene, butylene, pentylene, hexylene, or heptylene; a toner composition wherein the polyester resin can further be comprised of an additional branching segment, p or q, or mixtures thereof as illustrated by the formulas

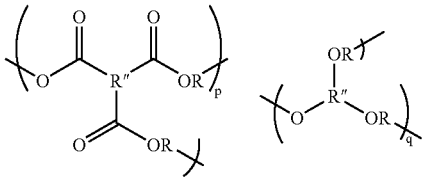

wherein R" can be a trivalent aromatic or aliphatic radical with from about 3 to about 20 carbon atoms; and p and q represent the branching segment and are from about 0.1 to about 6 mole percent based on the starting diacid or diester used to prepare the resin, and wherein the sum of segments p and q is 100 mole percent of the polyester resin; a toner composition wherein R" is the trivalent derivatives of propane, butane, pentane, hexane, cyclohexane, heptane, octane, benzene, naphthalene, or anthracene; a toner composition wherein p and q each are from about 0.1 to about 6 mole percent based on the diacid or diester reactant selected for the preparation of the polyester; a toner composition wherein the polyester resin is further comprised of an additional branching segment, r or s, or mixtures thereof as illustrated by the formulas

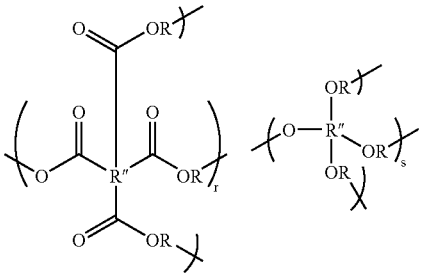

wherein R" is a multifunctional radical, and wherein the sum of segments r and s are 100 mole percent of the polyester resin; a toner composition wherein R" can be a polyvalent or tetravalent aromatic or aliphatic radical with from about 3 to about 20 carbon atoms for the aliphatic, and from about 6 to about 30 for the aromatic; and r and s represent the branching segment and are from about 0.1 to about 6 mole percent based on the starting diacid or diester; a toner composition wherein the polyester hydrophobic groups are end groups of poly(1,2-propylene terephthalate-co-diethylene terephthalate) end blocked with an alkyl group of, for example, stearyl, stearate, or $—(CH_2)_p—CH_3$ wherein p is from about 20 to about 60 and derived from a Unilin alcohol; poly(1,2-propylene terephthalate-co-diethylene terephthalate-co-1,1,1-trimethylene propane terephthalate) end blocked with an alkyl group of stearyl or stearate, poly(1,2-propylene terephthalate) end blocked with an alkyl group such as stearyl or stearate, poly(1,2-propylene terephthalate-co-diethylene terephthalate) end blocked with alkyl group of lauryl or laurate, poly(1,2-propylene terephthalate-co-diethylene terephthalate) end blocked with an alkyl group of cetyl or palmitate, poly(1,2-propylene terephthalate-co-diethylene terephthalate) end blocked with octoate, poly(1,2-propyleneterephthalate-co-diethylene terephthalate) end blocked with an alkyl group of palmitate, stearyl, lauryl, palmitate, stearate, or laurate; and mixtures thereof; a toner composition wherein the polyester Y can be an ion salt of a sulfonated difunctional monomer wherein the ion is an alkali or alkaline earth of lithium, sodium, potassium, cesium, rubidium, magnesium, barium, calcium or berylium, and the sulfonated difunctional moiety or monomer can be selected from the group consisting of dimethyl-5-sulfo-isophthalate, dialkyl-5-sulfo-isophthalate-4-sulfo-1,8-naphthalic anhydride, 4-sulfo-phthalic acid, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, dialkyl-sulfo-terephthalate, sulfo-ethanediol, 2-sulfo-propanediol, 2-sulfo-butanediol, 3-sulfopentanediol, 2-sulfo-hexanediol, 3-sulfo-2-methylpentanediol, N,N-bis(2-hydroxyethyl)-2-aminoethane sulfonate, 2-sulfo-3,3-dimethylpentanediol, sulfo-p-hydroxybenzoic acid, and mixtures thereof.

In one embodiment, the toner compositions comprise a polyester resin of the formula

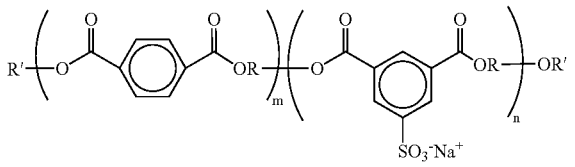

wherein R, R', m and n are as defined above and the toner particles have an average diameter of, from about 3 μm to about 12 μm, or from about 4 μm to about 7 μm.

In another embodiment, a toner composition comprises a polyester resin as defined above, wherein the polyester resin possesses a number average molecular weight of from about 2,000 grams per mole to about 100,000 grams per mole, a weight average molecular weight of from about 4,000 grams per mole to about 250,000 grams per mole, and a polydispersity of from about 1.8 to about 17; a toner composition with a triboelectric charge relative humidity sensitivity of from about 1.0 to about 2.8; a toner composition with a triboelectric charge relative humidity sensitivity of from about 1 to about 2.5; a toner composition wherein a charge enhancing additive is further included and is present in an amount of, for example, from about 0.05 to about 5 weight percent, and there results a positively or negatively charged toner; a toner composition wherein the charge enhancing additive is incorporated into the toner, or is present on the surface of the toner composition, and there results a positively or negatively charged toner; a toner composition further containing a wax component with a weight average molecular weight of, for example, from about 1,000 to about 20,000; a toner composition wherein the wax component is selected from the group consisting of polyethylene and polypropylene; a toner composition further containing as external additives metal salts of a fatty acid, colloidal silicas, metal oxides, or mixtures thereof; a toner composition wherein the colorant is carbon black, cyan, magenta, yellow, red, blue, green, brown, or mixtures thereof; a developer composition comprised of the polyester containing toner composition and carrier particles; a method of imaging which comprises formulating an electrostatic latent image on a negatively charged photoreceptor, affecting development thereof with the polyester containing toner composition illustrated herein, and thereafter transferring the developed image to a suitable substrate; a process for the preparation of a polyester resin with both at least one hydrophilic moiety and at least one hydrophobic end group, and preferably two end groups, which comprises the polyesterification of a diester or diacid with a diol or mixtures of diols, a polycondensation catalyst, a polyfunctional reagent, and a monofunctional hydrophobic end group monomer; a process wherein the diester or diacid is a malonic acid, succinic acid, 2-methylsuccinic acid, 2,3-dimethylsuccinic acid, dodecylsuccinic acid, glutaric acid, adipic acid, 2-methyladipic acid, pimelic acid, azelaic acid, sebacic acid, terephthalic acid, isophthalic acid, phthalic acid, 1,2-cyclohexanedioic acid, 1,3-cyclohexanedioic acid, 1,4-cyclohexanedioic acid, glutaric anhydride, succinic anhydride, dodecylsuccinic anhydride, maleic anhydride, fumaric acid, maleic acid, itaconic acid, 2-methylitaconic acid, dialkyl esters, wherein alkyl contains about 1 carbon atom to about 5 carbon atoms and are diesters of malonic acid, succinic acid, 2-methyl succinic acid, 2,3-dimethylsuccinic acid, dodecylsuccinic acid, glutaric acid, adipic acid, 2-methyladipic acid, pimelic acid, azelaic acid, sebacic acid, terephthalic acid, isophthalic acid, phthalic acid, 1,2-cyclohexanedioic acid, 1,3-cyclohexanedioic acid, 1,4-cyclohexanedioic acid, mixtures thereof; and which diester, or diacid is optionally selected in effective amounts of from about 45 to about 55 mole percent of the polyester resin; wherein the diol or glycol is diethylene glycol, ethylene glycol, 1,2-propylene glycol, 1,3-propylene glycol, 1,2-butylene glycol, 1,3-butylene glycol, 1,4-butylene glycol, 1,2-pentylene glycol, 1,3-pentylene glycol, 1,4-pentylene glycol, 1,5-pentylene glycol, 1,2-hexylene glycol, 1,3-hexylene glycol, 1,4-hexylene glycol, 1,5-hexylene glycol, 1,6-hexylene glycol, heptylene glycols, octylene glycols, decylene glycol, dodecylene glycol, 2,2-dimethyl propanediol, propoxylated bisphenol A, ethoxylated bisphenol A, 1,4-cyclohexane diol, 1,3-cyclohexane diol, 1,2-cyclohexane diol, 1,2-cyclohexane dimethanol, or mixtures thereof; and which glycol is optionally selected in effective amounts of from about 45 to about 55 mole percent of the polyester resin; wherein there is selected for the reaction a polycondensation catalyst of tetraalkyl titanates, dialkyltin oxide, tetraalkyl tin, alkyltin oxide hydroxide, aluminum alkoxides, alkyl zinc, dialkyl zinc, zinc oxide, zinc acetate, stannous oxide, or mixtures thereof, and which catalysts are optionally selected in effective amounts of from about 0.01 mole percent to about 5 mole percent based on the starting diacid or diester used to prepare the resin, and wherein the monofunctional hydrophobic end group monomer is decanol, undecanol, dodecanol, tridecanol, tetradecanol, pentadecanol, hexadecanol, heptadecanol, octadecanol, nonadecanol and other alcohols such as Unilin® and having from about 20 to about 100 carbon atoms, oleyl alcohol, linoleyl alcohol, cinnamyl alcohol, alkyl substituted alcohols 2-methylhexanol, 2,3,3-trimethylhexanol, 2-methyloctanol and 3,7-dimethyl-1,6-octadien-3-ol, and benzyl alcohol; monofunctional acids butyric acid, hexanoic acid, heptanoic acid, octanoic acid, nonanoic acid, decanoic acid, stearic acid, lauric acid, palmitic acid, oleic acid, linoleic acid, cinnamic acid, higher alkyl acids derived from about 4 to about 24 carbon atoms, benzoic acid, naphthoic acid, or mixtures thereof; and which group is optionally present in effective amounts of from about 0.1 mole percent to about 4 mole percent based on the starting diacid or diester used to prepare the resin; a process wherein the polycondensation is accomplished at a temperature of from about 165° C. to about 190° C. for a duration of from about 3 to about 4 hours, followed by increasing the temperature to from about 180° C. to about 200° C. for about 75 minutes to about 90 minutes and reducing the pressure from atmospheric of about 52400 millibars to from about 0.1 millibar to about 100 millibars for a duration of from about 1 hour to about 3 hours, then raising the temperature of the reaction to from about 200° C. to about 215° C. for a period of from about 2 hours to about 4 hours, followed by re-pressurizing the reactor back to atmospheric pressure or to about 52400 millibars and discharging the polyester product through the bottom drain valve, and cooling to ambient temperature or 25° C.; a toner composition further containing a charge enhancing additive of a quaternary ammonium compound; a toner composition further containing a charge additive of hydroxy bis(3,5-ditertiary butyl salicylic) aluminate monohydrate, 3,5-ditertiary butyl salicylate, an aluminum compound of a hydroxy carboxylic acid, cetyl pyridinium halide, or distearyl dimethyl ammonium methyl sulfate, wherein the surface additives are comprised of metal salts of a fatty acid, colloidal silicas, metal oxides, or mixtures thereof, and wherein each surface additive is present in an amount of from about 0.1 to about 5 weight percent; a toner wherein the moiety or group is present on the main chain of the polymer, or is present as a pendant group; a toner composition wherein the polyester is generated from at least one multifunctional branching monomer; a toner comprised of a polyester resin containing at least one hydrophilic segment, hydrophobic segments, and colorant; a toner further containing a wax; a toner further containing surface additives; a toner wherein the surface additives are comprised of silica, metal oxides, metal salts of fatty acids, or mixtures thereof; a toner wherein each of the surface additives is present in an amount of from about 0.5 to about 3 weight percent or parts; a toner composition further containing wax, charge enhancing additive, and surface additives; a toner wherein the polyester R' represents the hydrophobic group, and Y represents the hydrophilic group; a toner wherein the polyester comprises at least two hydrophobic end groups; a toner wherein the polyester comprises from about 2 to about 10 hydrophilic moieties; and toner compositions comprised of pigment or dye, and a polyester having chemically attached thereto a hydrophilic moiety such as an alkali sulfonate, especially an alkaline earth metal such as lithium, sodium, potassium, rubidium, cesium, berylium, magnesium, calcium, or barium, and hydrophobic end groups, such as an alkyl moiety comprised of a hydrocarbon, especially alkyl, preferably of from about 4 carbon atoms to about 120 carbon atoms.

Examples of polyester resins having hydrophobic end groups, for example, two or one at each end, and hydrophilic groups that can be used in the toner compositions include polyesters with alkyl end groups of the formulas illustrated herein such as copoly(1,2-propylene-5-sulfoisophthalate sodio salt)-copoly(1,2-propylene terephthalate-co-diethylene terephthalate) end blocked with stearate or, copoly(1,2-propylene-5-sulfoisophthalate sodio salt)-copoly(1,2-propylene terephthalate) end blocked with stearate, copoly(1,2-propylene-5-sulfoisophthalate sodio salt)-copoly(1,2-propylene terephthalate-co-diethylene terephthalate) end blocked with laurate, copoly(1,2-propylene-5-sulfoisophthalate sodio salt)-copoly(1,2-propylene terephthalate-co-diethylene terephthalate) end blocked with polyethylene, copoly(diethylene-5-sulfoisophthalate sodio salt)-copoly(1,2-propylene terephthalate-co-diethylene terephthalate) end blocked with octoate, copoly(1,2-propylene-5-sulfoisophthalate lithio salt)-copoly(1,2-propylene terephthalate-co-diethylene terephthalate) end blocked with a hexyl group, copoly(1,2-propylene-5-sulfoisophthalate potassio salt)-poly(1,2-propylene terephthalate-co-diethylene terephthalate) end blocked with a dodecyl group, copoly(1,2-propylene-5-sulfoisophthalate magnesio salt)-co-poly(1,2-propylene terephthalate-co-diethylene terephthalate) end blocked with a decyl group, copoly(1,2-propylene-5-sulfoisophthalate sodio salt)-copoly(1,2-propylene terephthalate-co-diethylene terephthalate) end blocked with a benzyl group, mixtures thereof, and the like; and which polyesters possess, for example, a number average molecular weight of from about 2,000 grams per mole to about 100,000, or about 20,000 to about 75,000 grams per mole, a weight average molecular weight, or from about 25,000 to about 125,000 of from about 4,000 grams per mole to about 250,000 grams per mole, and a polydispersity of from about 1.8 to about 17, all as measured by gel permeation chromatography.

The polyester resin having hydrophilic moieties and hydrophobic end groups that can be selected for the toner and developer compositions include those, such as copoly (1,2-propylene-5-sulfoisophthalate sodio salt)-copoly(1,2-propylene terephthalate-co-diethylene terephthalate) end blocked with a polyethylene end group of about 45 carbon atoms, and can be prepared by charging a 2 liter Parr reactor equipped with a mechanical stirrer, a distillation apparatus and bottom drain valve, with a mixture of from about 0.9 to about 0.95 mole of diester, such as dimethylterephthalate, from about 0.025 to about 0.05 mole of sulfonate monomer, such as 5-sulfo-isophthalate sodio salt, from about 1.75 moles to about 1.85 moles of a diol, such as 1,2-propanediol or diethylene glycol or a mixture of the diols, containing from about 0.15 to about 0.3 mole of diethylene glycol, from about 0.01 to about U.S. Pat. Nos. 4,883,736 and 6,017,671, the disclosures of which is totally incorporated herein by reference, (available from Petrolite Chemicals), and from about 0.001 mole to about 0.05 of a condensation catalyst such as butyltin oxide hydroxide. The reactor is subsequently heated, for example, to about 165° C. for a suitable duration of, for example, from about 360 minutes to about 720 minutes with stirring at, for example, from about 10 revolutions per minute to about 200 revolutions per minute. During this time, from about 1.7 moles to about 1.9 moles of methanol byproduct can be collected through the distillation receiver. The reactor temperature is then raised to about 185° C. for a period of from about 75 minutes to about 3 hours, followed by an increased in temperature to about 195° C. for about a period of from about 75 minutes to about 90 minutes; and the pressure is reduced to about 0.1 Torr over a period of from about 90 minutes to about 130 minutes; and glycols collect in the distillation receiver. The temperature of the reactor was then raised to about 210° C. over a 3 hour period, followed by re-pressurizing the reactor back to atmospheric pressure of about 52400 millibars. The polymeric resin comprised of copoly(1,2-propylene-5-sulfoisophthalate sodio salt)-poly(1,2-propylene terephthalate-co-diethylene terephthalate) end blocked with polyethylene groups of about 45 carbon atoms, has a Tg of about 60° C. and a softening point of about 165° C. is then discharged through the bottom of the reactor and cooled to room temperature of about 25° C.

Toners prepared with the polyester resins can be obtained by a chemical process such as admixing and heating the polyester resin particles such as copoly(1,2-propylene-5-sulfoisophthalate potassio salt)poly(1,2-propylene terephthalate-co-diethylene terephthalate) end blocked with polyethylene group of about 45 carbon atoms, and colorant particles such as magnetites, carbon black, or mixtures thereof, and preferably from about 0.20 percent to about 5 percent of optional charge enhancing additives, or mixtures of charge additives, and optionally wax in a melt mixing device, such as the ZSK72 extruder available from Werner Pfleiderer. After cooling, the toner composition is separated by sieving to obtain particles with a volume median diameter of less than about 25 μm, and preferably from about 3 μm to about 8 μm, or from about 4 μm to about 6 μm as determined by a Coulter Counter. The toner particles can be classified by utilizing, for example, a Donaldson Model B classifier for the purpose of removing finer toner particles, for example less than about 2 microns volume median diameter.

Exemplary diols utilized in preparing the polyesters, include diols or glycols such as ethylene glycol, 1,2-propylene glycol, 1,3-propylene glycol, 1,2-butylene glycol, 1,3-butylene glycol, 1,4-butylene glycol, 1,2-pentylene glycol, 1,3-pentylene glycol, 1,4-pentylene glycol, 1,5-pentylene glycol, 1,2-hexylene glycol, 1,3-hexylene glycol, 1,4-hexylene glycol, 1,5-hexylene glycol, 1,6-hexylene glycol, heptylene glycols, octylene glycols, decylene glycol, dodecylene glycol, 2,2-dimethyl propanediol, propoxylated bisphenol A, ethoxylated bisphenol A, 1,4-cyclohexane diol, 1,3-cyclohexane diol, 1,2-cyclohexane diol, 1,2-cyclohexane dimethanol, mixtures thereof, and the like; and these glycols can be employed in various effective amounts of, for example, from about 45 to about 55 mole percent of the polyester product resin.

Exemplary diacids or diesters utilized in preparing the polyesters, include malonic acid, succinic acid, 2-methylsuccinic acid, 2,3-dimethylsuccinic acid, dodecylsuccinic acid, glutaric acid, adipic acid, 2-methyladipic acid, pimelic acid, azelaic acid, sebacic acid, terephthalic acid, isophthalic acid, phthalic acid, 1,2-cyclohexanedioic acid, 1,3-cyclohexanedioic acid, 1,4-cyclohexanedioic acid, glutaric anhydride, succinic anhydride, dodecylsuccinic anhydride, maleic anhydride, fumaric acid, maleic acid, itaconic acid, 2-methyl itaconic acid, and dialkyl esters of these diacids and dianhydrides, wherein the alkyl groups of the dialkyl ester are of one carbon atom to about 5 carbon atoms and mixtures thereof, and the like, and which component is employed, for example, in amounts of from about 45 to about 55 mole percent of the resin.

Exemplary polycondensation catalysts, include tetraalkyl titanates, dialkyltin oxide such as dibutyltin oxide, tetraalkyltin such as dibutyltin dilaurate, dialkyltin oxide hydroxide such as butyltin oxide hydroxide, aluminum alkoxides, alkyl zinc, dialkyl zinc, zinc oxide, zinc acetate, stannous oxide, or mixtures thereof; and which catalysts are selected in effective amounts of from about 0.01 mole percent to about 5 mole percent based on the starting diacid or diester used to generate the polyester resin.

Monofunctional hydrophobic monomers which can be utilized for preparing the polyesters include monofunctional alcohols such as hexanol, heptanol, octanol, nonanol, decanol, undecanol, dodecanol, tridecanol, tetradecanol, pentadecanol, hexadecanol, heptadecanol, octadecanol, and other alcohols, such as those derived from components with about 6 to about 24 carbon atoms, oleyl alcohol, linoleyl alcohol, cinnamyl alcohol, alkyl substituted alcohols, such as 2-methylhexanol, 2,3,3-trimethylhexanol, 2-methyloctanol, 3,7-dimethyl-1,6-octadien-3-ol and the like, hydrophobic aromatic monomers such as benzyl alcohol, monofunctional acids such as hexanoic acid, heptanoic acid, octanoic acid, nonanoic acid, decanoic acid, stearic acid, lauric acid, palmitic acid, oleic acid, linoleic acid, cinnamic acid, and other alkyl acids, polyethylenealcohols or polypropylene alcohols such as Unilin® 350, Unilin®, 550, Unilin® 700 and the like, such as those derived from components with about 20 to about 120 carbon atoms, or from about 20 to about 60 carbon atoms; and which monomers can be selected in effective amounts of from about 0.1 mole percent to about 4.0 mole percent based on the starting diacid or diester used to make the resin.

Exemplary hydrophilic monomers, which can be utilized for the preparation of the polyester resin, include the ion salts of sulfonated difunctional monomers wherein the ion is an alkali or alkaline earth such as lithium, sodium, potassium, cesium, rubidium, magnesium, barium, calcium or berylium and the like, and the sulfonated difunctional moiety is selected from the group including dimethyl-5-sulfoisophthalate, dialkyl-5-sulfo-isophthalate-4-sulfo-1,8-naphthalic anhydride, 4-sulfo-phthalic acid, 4-sulfophenyl-3,5-dicarbomethoxybenzene, 6-sulfo-2-naphthyl-3,5-dicarbomethoxybenzene, sulfo-terephthalic acid, dimethylsulfo-terephthalate, dialkyl-sulfo-terephthalate, sulfoethanediol, 2-sulfo-propanediol, 2-sulfo-butanediol, 3-sulfopentanediol, 2-sulfo-hexanediol, 3-sulfo-2-methylpentanediol, N,N-bis(2-hydroxyethyl)-2-aminoethane sulfonate, 2-sulfo-3,3-dimethylpentanediol, sulfo-p-hydroxybenzoic acid, mixture thereof and the like. Effective hydrophilic amounts of, for example, from about 3 to about 8 weight percent, or from about 4 to about 6 weight percent of the resin can be selected.

Additionally, crosslinking or branching agents can be utilized, such as trifunctional or multifunctional monomers, which agents usually increase the molecular weight and polydispersity of the polyester, and which agents can be selected from the group consisting of glycerol, trimethylol ethane, trimethylol propane, pentaerythritol, sorbitol, diglycerol, trimellitic acid, trimellitic anhydride, pyromellitic acid, pyromellitic anhydride, 1,2,4-cyclohexanetricarboxylic acid, 2,5,7-naphthalenetricarboxylic acid, 1,2,4-butanetricarboxylic acid, mixtures thereof, and the like; and which agents can be selected in effective amounts of from about 0.1 mole percent to about 6.0 mole percent based on the starting diacid or diester used to make the resin.

Numerous suitable colorants, such as pigments or dyes can be selected as the colorant for the toner, including, for example, cyan, magenta, yellow, red, blue, green, carbon black like REGAL 330®, nigrosine dye, aniline blue, phthalocyanines, magnetite, or mixtures thereof. A number of carbon blacks available from, for example, Cabot Corporation. The colorant, which is preferably carbon black, should be present in a sufficient amount to render the toner composition colored. The colorant can be present in amounts of from about 1 percent by weight to about 20 percent by weight, and preferably from about 2 to about 10 weight percent based on the total weight of the toner composition, and wherein the total of all of the toner components is about 100 percent. Colorant includes dyes, pigments, mixtures thereof, mixtures of pigments, mixtures of dyes, and other suitable colorants that impart a desired color to the toner. Dye examples include other suitable dyes, such as food dyes.

When the colorant particles are comprised of magnetites, thereby enabling single component magnetic toners in some instances, which magnetites are a mixture of iron oxides such as FeO and $Fe_2O_3$, including those commercially available as MAPICO BLACK®, they can be present in the toner composition in an amount of from about 10 percent by weight to about 80 percent by weight, or in an amount of from about 10 percent by weight to about 50 percent by weight. Mixtures of carbon black and magnetite with from about 1 to about 15 weight percent of carbon black, and preferably from about 2 to about 6 weight percent of carbon black, and magnetite, such as MAPICO BLACK®, in an amount of, for example, from about 5 to about 60, and preferably from about 10 to about 50 weight percent can be selected.

Charge additive examples include those as illustrated in U.S. Pat. No. 4,338,390, the disclosure of which is totally incorporated herein by reference, which additives preferably impart a positive charge to the toner composition; alkyl pyridinium compounds as disclosed in U.S. Pat. No. 4,298,672, the disclosure of which is totally incorporated herein by reference, the charge control additives as illustrated in U.S. Pat. Nos. 3,944,493; 4,007,293; 4,079,014; 4,394,430, and 4,560,635, the disclosures of which is totally incorporated herein by reference, which illustrates a toner with a distearyl dimethyl ammonium methyl sulfate charge additive, bisulfates, silicas, and other known toner charge additives. Negative charge additives can also be selected, such as zinc or aluminum complexes, like an aluminum compound of a hydroxy carboxylic acid (BONTRON E-88® from Orient Chemical Company), the zinc complex of 3,5-ditertiary butyl salicylate (BONTRON E-84® from Orient Chemical Company) and hydroxy bis(3,5-ditertiary butyl salicylic) aluminate monohydrate (Alohas), and the like.

The toner compositions can also include compatibilizers, such as those illustrated in U.S. Pat. No. 5,229,242, the disclosure of which is totally incorporated herein by reference, waxes, or mixtures thereof, such as polypropylenes and polyethylenes such as EPOLENE N-15™. commercially available from Eastman Chemical Products, Inc., VISCOL 550-P™, a low weight average molecular weight polypropylene available from Sanyo Kasei K.K., and similar materials. Polyethylenes can be selected to possess a molecular weight of from about 1,000 to about 3,000, such as those obtainable from Petrolite Corporation, while polypropylenes utilized for the toner compositions of the present invention are believed to possess a molecular weight of from about 4,000 to about 5,000. Many of the alkylenes like polyethylene and polypropylene compositions are illustrated in British Patent No. 1,442,835, the disclosure of which is totally incorporated herein by reference. The wax can be present in the toner composition in various amounts; for example, from about 1 percent by weight to about 15 percent by weight, or from about 2 percent by weight to about 10 percent by weight.

The toner compositions can also be blended with toner additives, such as external additive particles including flow aid additives, which additives can be present on the surface thereof. Exemplary additives include metal oxides, such as aluminum oxide, titanium oxide, tin oxide, cerium oxide mixtures thereof, and the like, colloidal fumed silicas, such as AEROSIL®, or Cabosil®, coated silicas, reference, for example, U.S. Ser. No. 08/131,188 and U.S. Pat. No. 6,190,815, the disclosures of which are totally incorporated herein by reference, metal salts and metal salts of fatty acids including zinc stearate, magnesium stearate, polymeric components such as polyvinylidene fluoride which is obtainable from ATOCHEM North America, Inc., polytetrafluoroethylene available from ICI Advanced Materials, or polymeric microspheres of from 0.1 to 2.0 microns, such as those obtainable from Nippon Paint, Osaka, Japan, and mixtures thereof, which additives can be present in an amount of from about 0.1 percent by weight to about 5 percent by weight, or in an amount of from about 0.1 percent by weight to about 3 percent by weight. A number of toner additives are illustrated in U.S. Pat. Nos. 3,590,000 and 3,800,588, the disclosures of which are totally incorporated herein by reference.

Colloidal silicas, such as AEROSIL®, can be surface treated with known charge additives, such as DDAMS (distearyidimethyl ammonium methyl sulfate), in an amount of from about 1 to about 30 weight percent, or about 10 weight percent, followed by the addition thereof to the toner in an amount of from 0.1 to about 10, or from 0.1 to about 1 weight percent.

The toners include colored toner and developer compositions comprised of toner polyester resin particles, and as colorants red, blue, green, brown, magenta, cyan and/or yellow particles, as well as mixtures thereof. More specifically, with regard to the generation of color images, illustrative examples of magentas that may be selected include, for example, 2,9-dimethyl-substituted quinacridone identified in the Color Index as CI 73915, Pigment Red 122, anthraquinone dye identified in the Color Index as CI 60710, CI Dispersed Red 15, diazo dye identified in the Color Index as CI 26050, CI Solvent Red 19, and the like; examples of cyans that may be selected include copper tetra-4-(octadecyl sulfonamido) phthalocyanine, beta-copper phthalocyanine pigment listed in the Color Index as CI 74160 Pigment Blue 15.3 and Anthrathrene Blue, identified in the Color Index as CI 69810, Special Blue X-2137, and the like; and illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL. These colorants can be incorporated into the toner composition in various suitable effective amounts such as from about 2 percent by weight to about 15 percent by weight calculated on the weight of the toner resin particles.

Developer compositions can be formulated by mixing carrier components with the toner particles, particularly those that can be capable of triboelectrically assuming an opposite polarity to that of the toner composition. Accordingly, the carrier particles can be selected to be of a negative or positive polarity enabling the toner particles, which are oppositely charged, to adhere to and surround the carrier particles. Illustrative examples of carrier particles include iron powder, steel, nickel, iron, ferrites, including copper zinc ferrites, strontium ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxy silane, reference U.S. Pat. Nos. 3,526,533 and 3,467,634, the disclosures of which are totally incorporated herein by reference; polymethyl methacrylates; other known coatings; and the like. The carrier particles may also be included in the coating, which coating can be present in embodiments in an amount of from about 0.1 to about 3 weight percent, conductive substances, such as carbon black, in an amount of, for example, from about 5 to about 30 percent by weight. Polymer coatings not in close proximity in the triboelectric series can also be selected, reference U.S. Pat. Nos. 4,937,166 and 4,935,326, the disclosures of which are totally incorporated herein by reference, including, for example, KYNAR.®. and polymethylmethacrylate mixtures like 40/60. Coating weights can vary as indicated herein; for example, from about 0.3 to about 2, or from about 0.5 to about 1.5 weight percent coating weight is selected.

Furthermore, the diameter of the carrier particles, which can be spherical in shape, can be from about 35 μm to about 1,000 μm, or from about 50 μm to about 200 μm in diameter, thereby permitting them to, for example, possess sufficient density and inertia to avoid adherence to the electrostatic images during the development process. The carrier component can be mixed with the toner composition in various suitable combinations, such as from about 1 to 5 parts per toner to about 100 parts to about 200 parts by weight of carrier, are selected.

The toner and developer compositions may be selected for use in electrostatographic imaging apparatuses containing therein photoconductive imaging members, such as those illustrated in U.S. Pat. Nos. 5,534,376; 5,456,998; 5,466,796; 5,563,261, 5,645,965, metal phthalocyanines, metal free phthalocyanines, perylenes, titanyl phthalocyanines, and the like. Thus, the toner and developer compositions can be used with layered photoreceptors that are capable of being charged negatively, or positively, such as those described in U.S. Pat. Nos. 4,265,990; 4,585,884; 4,584,253; 4,563,408, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys. Other similar suitable photoreceptors or photoconductive imaging members can be selected.

The toner compositions can be jetted and classified subsequent to preparation to enable toner particles with a average diameter of, for example, from about 3 μm to about 12 μm, or from about 4 μm to about 7 μm. Also, the toner compositions may possess a triboelectric charge of from about 5 to 40 microcoulombs per gram in embodiments thereof as determined by the known charge spectograph. Admix time for the toners can be from about 15 seconds to 1 minute, and more specifically, from about 15 to about 30 seconds in embodiments thereof as determined by a charge spectograph. These toner compositions with rapid admix characteristics enable, for example, the development of latent electrostatographic images in electrophotographic imaging apparatuses, which developed images have substantially no background deposits thereon, even at high toner dispensing rates in some instances, for instance exceeding 20 grams per minute; and further, such toner compositions can be selected for high speed electrophotographic apparatuses, for example, those exceeding 70 copies per minute. The toner compositions can be used in a xerographic system comprising a charging component, a photoconductive component, a development component, an image transfer component and a fusing component, and wherein the development component contains the toner composition as described herewith.

In another embodiment, a process for preparing the toner compositions is also provided. In this embodiment, the process comprises mixing an emulsion of a polyester resin with a pigment as described above, the polyester resin comprising the formula

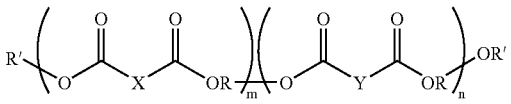

wherein R is an alkylene group;

X is an aromatic hydrocarbon;

Y is an alkali or alkaline earth metal salt of an arylenesulfonate or an alkylenesulfonate and comprises from about 3 mole percent to about 8 mole percent of said polyester resin;

R' is a hydrophobic group, and m and n represent the number of random segments of from about 50 to about 300 for n, and from about 20 to about 2,000 for m, or m is less than 20 times n.

The mixture is then heated at a temperature of from about 50° C. to about 75° C. with stirring. Thereafter, a solution comprising a catalyst such as a metal acetate, for example, zinc acetate is added drop wise to the mixture to form toner particles. The size of the toner particles is then monitored in a Coulter Counter apparatus until the volume particle size is less than 25 μm, or from about 3 μm to about 12 μm, with a geometric distribution of about 1.3. The mixture is then cooled to room temperature, or from about 25° C. to about 30° C., or from about 20° C. to about 26° C. The toner particles are then separated followed by filtration, washing and freeze-drying of the toner particles. The process may further comprise the step of adding to said mixture a wax, or a charge additive, or surface additives or combinations of each component to said mixture prior to filtration.

Weight percent in embodiments refers to the total amount of components, especially solids, divided into the specific component and multiplied by 100. For example, the weight percent of colorant, such as pigment can be calculated by subtracting the amount of pigment from the amount of pigment and resin and dividing the result by the amount of resin and pigment, and then multiplying by 100.

The following illustrative Examples are provided.

EXAMPLE 1

A toner comprised of 5 weight percent of Cyan pigment, and 95% polyester resin derived from 4 mole percent of sulfonated hydrophilic monomer and without any hydrophobic end groups was prepared as follows:

A 2 liter Parr reactor equipped with a mechanical stirrer, a distillation apparatus with a cold water condenser and a bottom drain valve was charged with 352 g of dimethylterepthalate, 53 g of 5-sulfoisophthalic acid sodium salt, 280 g of propylene glycol, 43 g of diethylene glycol, and 1 g of FASCAT 4100™ from Elf Atochem North America, Inc. The reaction was heated to 165° C. with stirring over a 3 hour period, followed by an increase in temperature of the reaction to 195° C. over a 1 hour period. The pressure was then reduced to 0.1 torr over a 2 hour period with glycols collecting in the distillation receiver. The temperature was then raised to 210° C. over a 3 hour period, followed by re-pressurizing the reactor back to atmospheric pressure and discharging the contents through the bottom drain valve to result with the sulfonated polyester resin with a Tg of 61° C. and softening point of 155.

Using a 4 liter beaker equipped with a mechanical stirrer, 200 g of the resin prepared as in Example 1, and 3 liters of water were added and the mixture was heated to 94° C. with stirring for 5.5 hours which mixture resulted in an emulsion having particles size of about 24.2 nm. A 2 liter glass reactor equipped with an overhead stirrer and heating mantle was charged with 1,026.69 g of the above emulsion containing 9.75% solids and 8.08 g of cyan Flexiverse pigment BFD1121 having a solid content of 48.9%. The mixture was heated to 68° C. with stirring at 200 RPMs. Thereafter, 500 g zinc acetate (3 wt % aqueous solution) was added drop wise over a 2.1 hour period. The particle size was monitored using a Coulter Counter until the volume average particle size was 5.48 μm with a geometric standard deviation, GSD of 1.31, and circularity of 0.965. The toner slurry was then cooled to room temperature, separated by sieving (25 μm), and filtration, followed by washing, and freeze-dried. The resultant toner product was comprised of 5 weight percent of Cyan pigment, and 95% polyester resin (the polyester resin was derived from 4 mole percent of sulfonated hydrophilic monomer and without any hydrophobic end groups).

EXAMPLE 2

A toner comprised of 5 weight percent of Cyan pigment, and 95% polyester resin derived from 2.5 weight percent of hydrophobic UNILIN® end groups, and 4.8 mole percent of sulfonated hydrophilic monomer was prepared as follows:

A 2 liter Parr reactor equipped with a mechanical stirrer, a distillation apparatus with a cold water condenser and a bottom drain valve was charged with 356 g of dimethylterepthalate, 51.3 g of 5-sulfoisophthalic acid sodium salt, 280 g of propylene glycol, 43 g of diethylene glycol, 12.5 g of UNILIN® 700 obtained from Petrolite and 1 g of FASCAT 4100™ from Elf Atochem North America, Inc. The reaction was heated to 165° C. with stirring over a 3 hour period, followed by an increase in temperature of the reaction to 195° C. over a 1 hour period. The pressure was then reduced to 0.1 torr over a 2 hour period with glycols collecting in the distillation receiver. The temperature was then raised to 210° C. over a 3 hour period, followed by re-pressurizing the reactor back to atmospheric pressure and discharging the contents through the bottom drain valve to result with the sulfonated polyester-UNILIN® resin with a Tg of 60.7° C. and softening point of 153.

Using a 4 liter beaker equipped with a mechanical stirrer, 200 g of the resin prepared as in Example 1 and 3 liters of water were added and the mixture was heated to 94° C. with stirring for 5.5 hours which resulted in an emulsion having particles size of about 24.2 nm. A 2 liter glass reactor equipped with an overhead stirrer and heating mantle was charged with 1026.69 g of the above emulsion containing 9.74% solids and 8.08 g of cyan Flexiverse pigment BFD1121 having a solid content of 48.9%. The mixture was heated to 68° C. with stirring at 200 RPM. Thereafter, 500 g zinc acetate (3 wt % aqueous solution) was added drop wise over a 2.1 hour period. The particle size was monitored using a Coulter Counter until the volume average particle size was 5.48 μm with a GSD of 1.31, circularity of 0.965. The toner slurry was then cooled to room temperature, separated by sieving (25 μm), and filtration, followed by washing, and freeze-dried. The resultant toner product was comprised of 5 weight percent of Cyan pigment, and 95% polyester resin (the polyester resin was derived from 2.5 weight percent of hydrophobic UNILIN® end groups, and 4.8 mole percent of sulfonated hydrophilic monomer).

EXAMPLE 3

A toner comprised of 5 weight percent of Cyan pigment, and 95% polyester resin derived from 3 weight percent of hydrophobic UNILIN® end groups, and 5 mole percent of sulfonated hydrophilic monomer was prepared as follows:

A 2 liter Parr reactor equipped with a mechanical stirrer, a distillation apparatus with a cold water condenser and a bottom drain valve was charged with 356 g of dimethylterepthalate, 55.8 g of 5-sulfoisophthalic acid sodium salt, 280 g of propylene glycol, 43 g of diethylene glycol, 14 g of UNILIN® 700 obtained from Petrolite and 1 g of FASCAT 4100™ from Elf Atochem North America, Inc. The reaction was heated to 165° C. with stirring over a 3 hour period, followed by an increase in temperature of the reaction to 195° C. over a 1 hour period. The pressure was then reduced to 0.1 torr over a 2 hour period with glycols collecting in the distillation receiver. The temperature was then raised to 210° C. over a 3 hour period, followed by re-pressurizing the reactor back to atmospheric pressure and discharging the contents through the bottom drain valve to result with the sulfonated polyester-UNILIN® resin with a Tg of 60.1° C. and softening point of 153.

Using a 4 liter beaker equipped with a mechanical stirrer, 200 g of the resin prepared as in Example 3 and 3 liters of water were added and the mixture was heated to 94° C. with stirring for 5.5 hours which resulted in an emulsion having particles size of about 22 nm. A 2 liter glass reactor equipped with an overhead stirrer and heating mantle was charged with 1026.69 g of the above emulsion containing 9.8% solids and 8.08 g of cyan Flexiverse pigment BFD1121 having a solid content of 48.9%. The mixture was heated to 68° C. with stirring at 200 RPM. Thereafter, 500 g zinc acetate (3 wt % aqueous solution) was added drop wise over a 2.1 hour period. The particle size was monitored using a Coulter Counter until the volume average particle size was 5.8 μm with a GSD of 1.31, circularity of 0.96. The toner slurry was then cooled to room temperature, separated by sieving (25 μm), and filtration, followed by washing and freeze-dried. The resultant toner product comprised of 5 weight percent of Cyan pigment, and 95% polyester resin (the polyester resin was derived from 3 weight percent of hydrophobic UNILIN® end groups, and 5 mole percent of sulfonated hydrophilic monomer).

EXAMPLE 4

A toner comprised of 5 weight percent of Cyan pigment, and 95% polyester resin derived from 3 weight percent of hydrophobic UNILIN® end groups, and 6 mole percent of sulfonated hydrophilic monomer was prepared as follows:

A 2 liter Parr reactor equipped with a mechanical stirrer, a distillation apparatus with a cold water condenser and a bottom drain valve was charged with 345 g of dimethylterepthalate, 65 g of 5-sulfoisophthalic acid sodium salt, 280 g of propylene glycol, 43 g of diethylene glycol, 13.8 g of UNILIN® 700 obtained from Petrolite and 1 g of FASCAT 4100™ from Elf Atochem North America, Inc. The reaction was heated to 165° C. with stirring over a 3 hour period, followed by an increase in temperature of the reaction to 195° C. over a 1 hour period. The pressure was then reduced to 0.1 torr over a 2 hour period with glycols collecting in the distillation receiver. The temperature was then raised to 210° C. over a 3 hour period, followed by re-pressurizing the reactor back to atmospheric pressure and discharging the contents through the bottom drain valve to result with the sulfonated polyester-UNILIN® resin with a Tg of 59.5° C. and softening point of 150.

Using a 4 liter beaker equipped with a mechanical stirrer, 200 g of the resin prepared as in Example 1 and 3 liters of water were added and the mixture was heated to 94° C. with stirring for 5.5 hours which resulted in an emulsion having particles size of about 20 nm. A 2 liter glass reactor equipped with an overhead stirrer and heating mantle was charged with 1026.69 g of the above emulsion containing 9.74% solids and 8.08 g of cyan Flexiverse pigment BFD1121 having a solid content of 48.9%. The mixture was heated to 68° C. with stirring at 200 RPM. Thereafter, 500 g zinc acetate (3 wt % aqueous solution) was added drop wise over a 2.1 hour period. The particle size was monitored using a Coulter Counter until the volume average particle size was 6.5 μm with a GSD of 1.31, circularity of 0.97. The toner slurry was then cooled to room temperature, separated by sieving (25 μm), and filtration, followed by washing, and freeze-dried. The resultant toner was comprised of toner comprised of 5 wieght percent of Cyan pigment, and 95% polyester resin (the polyester resin was derived from 3 weight percent of hydrophobic UNILIN® end groups, and 6 mole percent of sulfonated hydrophilic monomer).

EXAMPLE 5

Developers were prepared by mixing each of the above toners with a 65 micron Hoaganese steel core coated with 1 percent by weight of a composite of a polymer of PMMA (polymethylmethacrylate with the conductive carbon black, CONDUCTEX SC ULTRA®, dispersed therein, about 20 weight percent) and conditioned overnight (about 18 hours) at 20 percent and 80 percent relative humidity (RH) and charged for 30 minutes on a roll mill. For 5 to 6 μm toners, the toner concentration was 4 percent by weight of carrier.

All unfused images were generated using a modified Xerox copier. 1.05 mg/cm2 TMA (Toner Mass per unit Area)

images on CX paper (Color Xpressions, 90 gsm, uncoated) were for gloss and crease measurements while the 1.05 mg/cm2 images on FX S paper (60 gsm, uncoated) were used for hot offset tests; the above TMA corresponds to process black or three layers of toner particles (for 5.5 micron particles). The gloss/crease target is a square image placed in the centre of the paper while the hot offset target is a narrow rectangle located on the leading edge of the sheet. Samples were then fused on a known Xerox Corporation fusing test fixture.

Process speed of the fuser was set to 194 mm/s (nip dwell of ~30 ms) and the fuser roll temperature was varied from cold offset to hot offset or up to 210oC. for gloss and crease measurements. After the set point temperature of the fuser roll has been changed, wait five minutes to allow the temperature of the belt and pressure assembly to stabilize. Fuser roll process speed was then reduced to 104 mm/s and the 1.05 TMA S paper samples were fused to determine the temperature where hot offset occurs. When the background (toner in areas where no image is present) of the unfused sheet is high a section of paper is attached to the trailing edge to help with the detection of hot offset.

Document offset samples were imaged onto CX paper at 0.5 mg/cm2 and then run through the fuser roll temperature set to (MFTCA=80+10° C.) and fuser speed=194 mm/s. Toner to toner and toner to paper images were cut from the sheet, 5 cm by 5 cm, and placed under a 80 g/cm2 load at 60° C. and 50% R.H. The document offset were tested for 24 hours. The Fusing Results of the above toners are summarized in Table 1.

TABLE 1

| Toners | Comparative Example 1 | Example 2 | Example 3 | Example 4 |
|---|---|---|---|---|
| Cold Offset (° C.) | 120 | 115 | 110 | 121 |
| Fixing Temperature (° C.) | 164 | 163 | 166 | 163 |
| Hot Offset (° C.) | >210 | >210 | >210 | >210 |
| Gloss at Fixing Temperature | 25 | 35 | 47.5 | 20.2 |
| Peak Gloss | 52 | 48.6 | 66.7 | 46.7 |
| Document Offset | Poor | Good | Good | Good |

The results in Table 1 indicate, for example, an improvement in toner to paper document offset performance, without or with minimal alteration in fusing performance.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A toner composition comprised of a polyester resin with hydrophilic groups and hydrophobic end groups and a colorant, wherein said polyester resin is of the formula:

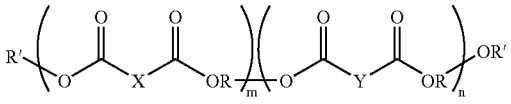

wherein R is an alkylene group;

X is an aromatic hydrocarbon;

Y is selected from the group consisting of an alkali and an alkaline earth metal salt of an arylenesulfonate or an alkylenesulfonate;

R' is a hydrophobic group, and m and n represent the number of random segments of from about 50 to about 300 for n, and from about 20 to about 2,000 for m, and m is less than 20 times n.

2. A toner composition in accordance with claim 1, wherein R' is derived from a polymeric alcohol.

3. A toner composition in accordance with claim 2, wherein the polymeric alcohol is from about 10 to about 120 carbon atoms, or from about 20 to about 60 carbon atoms.

4. A toner composition in accordance with claim 1, wherein said polyester resin is derived from at least one polymeric alcohol moiety of the formula —OH(CH2)$_p$CH$_3$, wherein p is a number of from about 10 to about 120, or from about 20 to about 60.

5. A toner composition in accordance with claim 1, wherein said R' hydrophobic group is an aliphatic hydrocarbon of from about 10 to about 120 carbon atoms, or from about 20 to about 60 carbons atoms in length.

6. A toner composition in accordance with claim 1, wherein said R alkylene group contains from about 2 to about 24 carbon atoms and is selected from the group consisting of diethylene, propylene, dipropylene, cycloalkylene, and 1,4-dimethyl cyclohexylene.

7. A toner composition in accordance with claim 1, wherein said Y comprises from about 3 mole percent to about 8 mole percent of the polyester resin.

8. A toner composition in accordance with claim 1, wherein said Y arylenesulfonate is phenylenesulfonate.

9. A toner composition in accordance with claim 1, wherein said X aromatic hydrocarbon is an aryl moiety selected from the group consisting of phenylene, isophthalylene, terephthalylene, and phthalylene.

10. A toner composition in accordance with claim 1, wherein said metal for said alkali or alkaline earth metal salt is selected from the group consisting of lithium, sodium, potassium, cesium, berylium, magnesium, calcium and barium.

11. A toner composition in accordance with claim 1, wherein said R' group comprises from about 0.5% to about 5% parts per weight based on the amount of polyester polymer.

12. A toner composition in accordance with claim 1, wherein said hydrophilic groups comprise from about 3 weight percent to about 8 weight percent, or from about 4 weight percent to about 6 weight percent of the polyester resin.

13. A toner composition in accordance with claim 1, further comprising a wax, a charge additive and surface additives.

14. A toner composition in accordance with claim 1, wherein said polyester resin is of the formula:

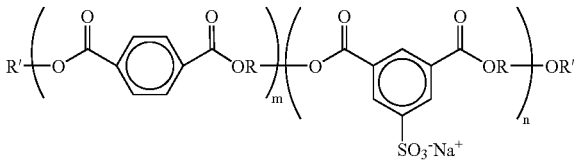

wherein R is an alkylene group;

R' is a hydrophobic group; and m and n represent the number of random segments of from about 50 to about 300 for n, and from about 20 to about 2,000 for m, and m is less than 20 times n.

15. A toner composition in accordance with claim 14, further comprising toner particles of an average volume diameter of, from about 3 μm to about 12 μm, or from about 4 μm to about 7 μm.

16. A toner composition in accordance with claim 1, wherein said R alkylene group contains from about 2 to about 24 carbon atoms and is selected from the group consisting of diethylene, propylene, dipropylene, cycloalkylene, and 1,4-dimethyl cyclohexylene.

17. A toner composition in accordance with claim 1, wherein R' hydrophobic group is an aliphatic hydrocarbon of from about 10 to about 120 carbon atoms, or from about 20 to about 60 carbons atoms in length.

18. A toner composition in accordance with claim 1, wherein said polyester resin is derived from at least one polymeric alcohol of the formula —OH(CH2)$_p$CH$_3$, wherein p is a number of from about 10 to about 120, or from about 20 to about 60.

19. A xerographic system comprising a charging component, a photoconductive component, a development component, an image transfer component and a fusing component and wherein the development component contains the toner composition of claim 1.

20. A process for the preparation of a toner composition comprising:

(a) mixing an emulsion of a polyester resin of the formula

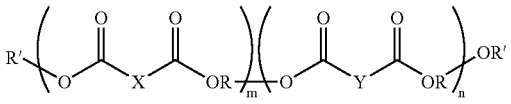

wherein R is an alkylene group;

X is an aromatic hydrocarbon;

Y is an alkali or alkaline earth metal salt of an arylenesulfonate or an alkylenesulfonate and comprises from about 3 mole percent to about 8 mole percent of said polyester resin;

R' is a hydrophobic group, and m and n represent the number of random segments of from about 50 to about 300 for n, and from about 20 to about 2,000 for m, or m is less than 20 times n, with a pigment to form a mixture and heating said mixture at a temperature of from about 50° C. to about 75° C. with stirring;

(b) adding a solution comprising a catalyst to said mixture to form toner particles;

(c) monitoring said toner particle size in said mixture until the volume particle size is less than 25 μm, or from about 3 μm to about 12 μm, with a geometric distribution of about 1.3;

(d) cooling said mixture to a temperature of from about 25° C. to about 30° C., or a temperature of from about 20° C. to about 26° C., and optionally separating said mixture followed by filtration, washing and freeze-drying said toner particles.

21. The process of claim 20, further comprising adding to said mixture a wax, a charge additive, and/or surface additives to said mixture prior to filtration.

22. The process of claim 20, wherein said X aromatic hydrocarbon is an arylene moiety selected from the group consisting of phenylene, isophthalylene, terephthalylene, and phthalylene.

23. The process of claim 20, wherein said metal of said alkali or alkaline earth metal salt of said arylenesulfonate is 5-sulfoisophthalic acid sodium salt.

24. The process of claim 20, wherein said R' hydrophobic group is of the formula —(CH2)$_p$CH$_3$, wherein p is a number of from about 10 to about 120 or from about 20 to about 60.

25. The process of claim 20, wherein said R alkylene group contains from about 2 to about 24 carbon atoms.

26. The process of claim 20, wherein R alkylene group is selected from the group consisting of diethylene, propylene, dipropylene, cycloalkylene, and 1,4-dimethyl cyclohexylene.

* * * * *